US005144725A

United States Patent [19]

Krauss

[11] Patent Number: 5,144,725

[45] Date of Patent: Sep. 8, 1992

[54] SIDE-RELEASE BUCKLE WITH ACCIDENTAL RELEASE GUARD

[75] Inventor: Mark J. Krauss, East Greenwich, R.I.

[73] Assignee: American Cord & Webbing, Inc., Woonsocket, R.I.

[21] Appl. No.: 729,935

[22] Filed: Jul. 15, 1991

[51] Int. Cl.[5] ..... A44B 11/25

[52] U.S. Cl. ..... 24/625; 24/616; 24/633

[58] Field of Search ..... 24/625, 633, 615, 616, 24/323, 313, 316, 196, 171

[56] References Cited

U.S. PATENT DOCUMENTS

| | | | |
|---|---|---|---|
| 3,430,306 | 3/1969 | Tareau | 24/625 |
| 4,035,877 | 7/1977 | Brownson et al. | 24/323 |
| 4,150,464 | 4/1979 | Tracy | 24/196 |
| 4,282,634 | 8/1981 | Krauss | 24/616 |
| 4,577,377 | 3/1986 | Kasai | 24/633 |
| 4,672,725 | 6/1987 | Kasai | 24/625 |
| 4,712,280 | 12/1987 | Fildan | 24/633 |
| 4,825,515 | 5/1989 | Wolterstorff, Jr. | 24/625 |
| 4,987,661 | 1/1991 | Kasai | 24/625 |

FOREIGN PATENT DOCUMENTS

| | | | |
|---|---|---|---|
| 2226129 | 12/1974 | France | 24/616 |
| 2451175 | 11/1980 | France | 24/616 |
| 2551635 | 3/1985 | France | 24/633 |

*Primary Examiner*—Victor N. Sakran

*Attorney, Agent, or Firm*—Kane, Dalsimer, Sullivan, Kurucz, Levy, Eisele and Richard

[57] ABSTRACT

A buckle is provided which includes a male portion and a female portion. The male portion includes inwardly deformable spring arms with detent protuberances. The detent protuberances engage detent apertures within detent recesses on lateral sides of the female portion. Lateral release guards are formed so as to shield the detent protuberances from being inadvertently depressed thereby releasing the male portion from the female portion. The lateral release guards include two portions meeting at an angle thereby forming a point of flexure. An internal rotatable locking assembly within the female portion can be rotated or a wedge can be slid within a channel so as to prevent the depression of the spring arms thereby locking the male and female portions to each other.

3 Claims, 3 Drawing Sheets

SIDE-RELEASE BUCKLE WITH ACCIDENTAL RELEASE GUARD

BACKGROUND OF THE INVENTION

1. Field of the Invention

This invention relates to a side-release buckle with detent means for a toolbelt, life preserver or similar apparatus. The side-release includes a guard to prevent accidental release of the detent means. Additionally, the buckle includes an internal rotatable or slidable locking assembly to block the depression of the detent means and thereby prevent the buckle from opening until the locking assembly is rotated or slid to a position which does not block the detent means.

2. Description of the Prior Art

It is well-known in the prior art to provide a plastic buckle with a release feature effected by pressing a portion of the buckle for nylon belts such as are used for toolbelts, life preservers, harnesses, seatbelts, scuba equipment and similar apparatus. U.S. Pat. No. 4,282,634 to Krauss discloses such a buckle wherein a front portion is depressed to release the buckle. U.S. Pat. Nos. 4,825,515 to Wolterstorff, Jr.; 4,712,280 to Fildan; 4,577,377 to Kasai; 4,171,555 to Bakker et al.; and 4,150,464 to Tracy disclose examples of such buckles wherein side portions are depressed to release the buckle. This design is deficient in that the side portions may be accidentally depressed by body movements of the user proximate to the buckle.

U.S. Pat. No. D312,430 to Crowle has attempted to alleviate these deficiencies by providing an accidental release guard to protect the side portions from accidental depression. However, these release guards are substantially flat which decreases the integrity and ease of any point of flexure thereby making the buckle difficult to operate as stress is applied to the release guard.

OBJECTS AND SUMMARY OF INVENTION

It is therefore an object of this invention to provide a buckle for nylon belts such as are used for toolbelts, life preservers, harnesses, seatbelts, scuba equipment and similar apparatus.

It is therefore a further object of this invention to provide a side-release for a buckle.

It is therefore a still further object of this invention to provide a means to prevent bodily or other movements from accidentally releasing the buckle.

It is therefore a final object of this invention to provide a release guard with two portions forming an angle therebetween to form a distinct point of flexure thereby providing a relief of pressure and elongation pressures during disengagement.

These and other objects are effectively attained by providing a buckle with a male and a female member. The male member includes two spring arms with detent means and a slotted tongue in a central position between the two spring arms. The female member includes a longitudinal aperture for receiving the slotted tongue and spring arms, or other similar structures. The slot of the tongue engages a centrally located spindle. As the male portion is inserted into the female portion, the interior sidewalls of the female portion and the tapered profile of the detent means depress the two spring arms toward the tongue. As the male portion reaches its final position within the female portion, the detent means of the spring arms of the male portion aligns recesses within the sidewalls of the female portion. This allows the detent means to snap into the recesses thereby fastening the male portion to the female portion.

The detent means of the spring arms are exposed through the recesses of the sidewalls of the female portion to provide a means for the user to disengage the female portion from the male portion by effecting the depression of spring arms through the recesses. In order to prevent the inadvertent depression of the spring arms, resilient release guards integral with the female portion form an arch over the recesses formed by two portions meeting at an angle thereby forming a point of flexure The user depresses the resilient release guards to effect the depression of the spring arms through the recesses and release the male portion from the female portion Additionally, the spindle which receives the slotted tongue serves as an axis for a locking assembly which can be rotatably located in a locked position wherein bars of the locking assembly prevent the spring arms from being depressed from the detent position thereby inhibiting the disengagement of the male portion from the female portion The locking assembly can be rotated via a knob on the front wall of the female portion to an unlocked position wherein the bars of the locking assembly do not inhibit the motion of the spring arms. Alternately, a sliding wedge may be used to selectively prevent the spring arms from being depressed from the detent position

BRIEF DESCRIPTION OF THE DRAWINGS

Further objects and advantages of the invention will become apparent from the description and claims, and from the accompanying drawings, wherein:

DETAILED DESCRIPTION OF THE PREFERRED EMBODIMENT

Figure 1:
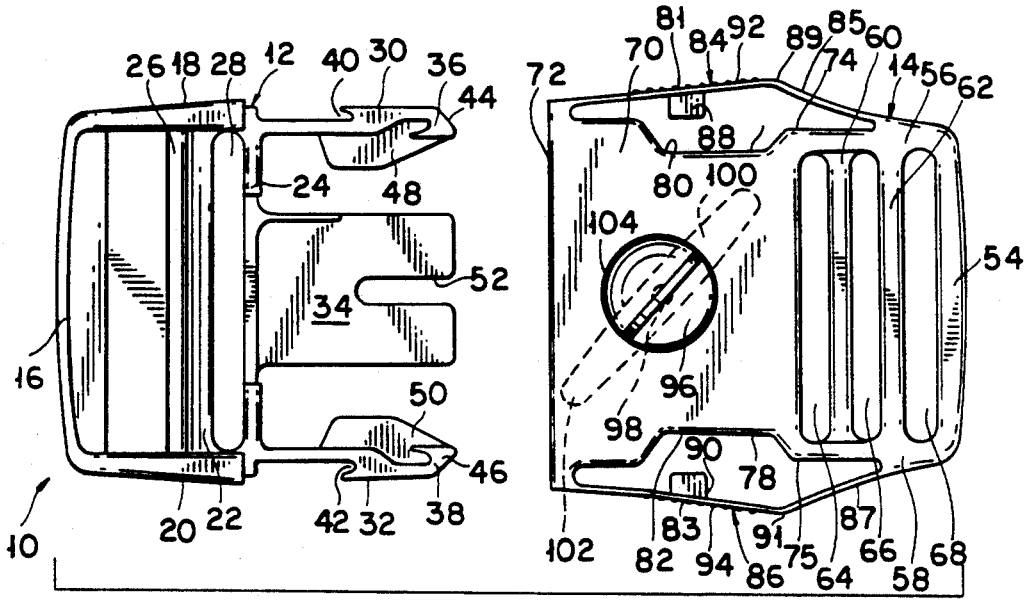
FIG. 1 is a front plan view, partly in phantom, of the disattached male and female portions of the buckle.

Referring now to the drawings in detail wherein like numerals indicate like elements throughout the several views, FIG. 1 discloses buckle 10 including male portion 12 and female portion 14. Male portion 12 includes C-shaped support 16 with horizontal members 18, 20 which engage belt support 22 and tongue support 24 therebetween. Openings 26, 28 are formed on both sides of belt support 22 so as to allow the passage of the belt (not shown) therethrough.

Tongue support 24, which is attached to horizontal members 18, 20 of C-shaped support 16, and which is adjacent to opening 28, is integral with spring arms 30, 32 on both ends thereof. Tongue support 24 is further integral with tongue 34.

Spring arms 30, 32 are inwardly flexible toward tongue 34. The free ends of spring arms 30, 32 include detent protuberances 36, 38, respectively. Detent protuberances 36, 38 include concave hook portions 40, 42, respectively, to enhance the detent function (to be described). Detent protuberances 36, 38 further include tapered faces 44, 46 to urge the spring arms 30, 32 as the spring arms 30, 32 are initially inserted into the female portion 14. Detent protuberances 36, 38 further include inserts 48, 50 which provide support for detent protuberances 36, 38 and provide a guide for the internal locking function (to be described).

Tongue 34 is in a central location integral with tongue support 24. Tongue 34 includes a centrally located longitudinal slot 52.

Figure 2:
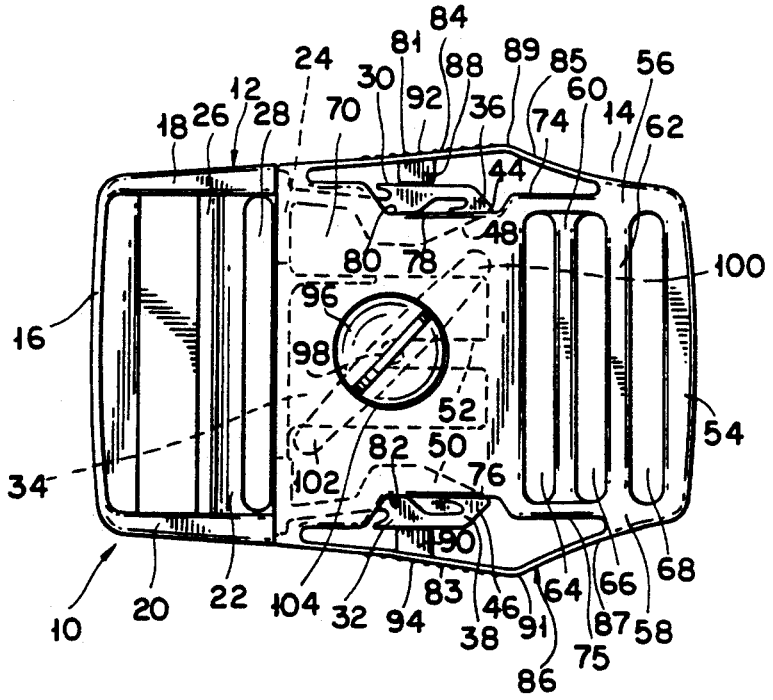
FIG. 2 is a front plan view, partly in phantom, of the attached male and female portions of the buckle.
Figure 3:
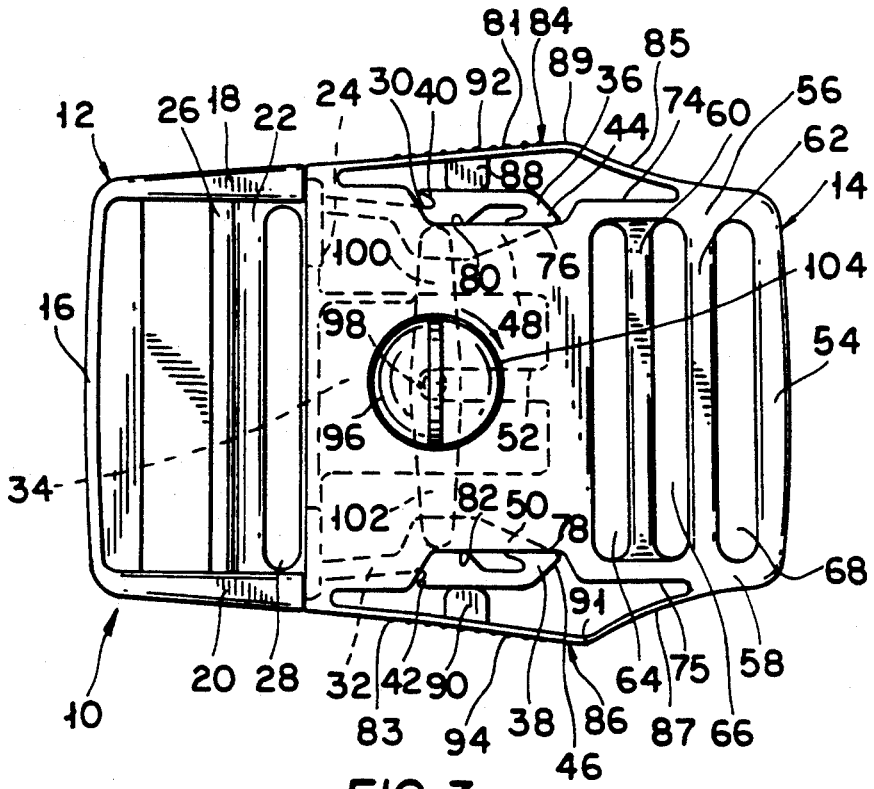
FIG. 3 is a front plan view, partly in phantom, of the attached male and female portions of the buckle with the rotatable locking assembly blocking the depression of the spring arms.
Figure 4:
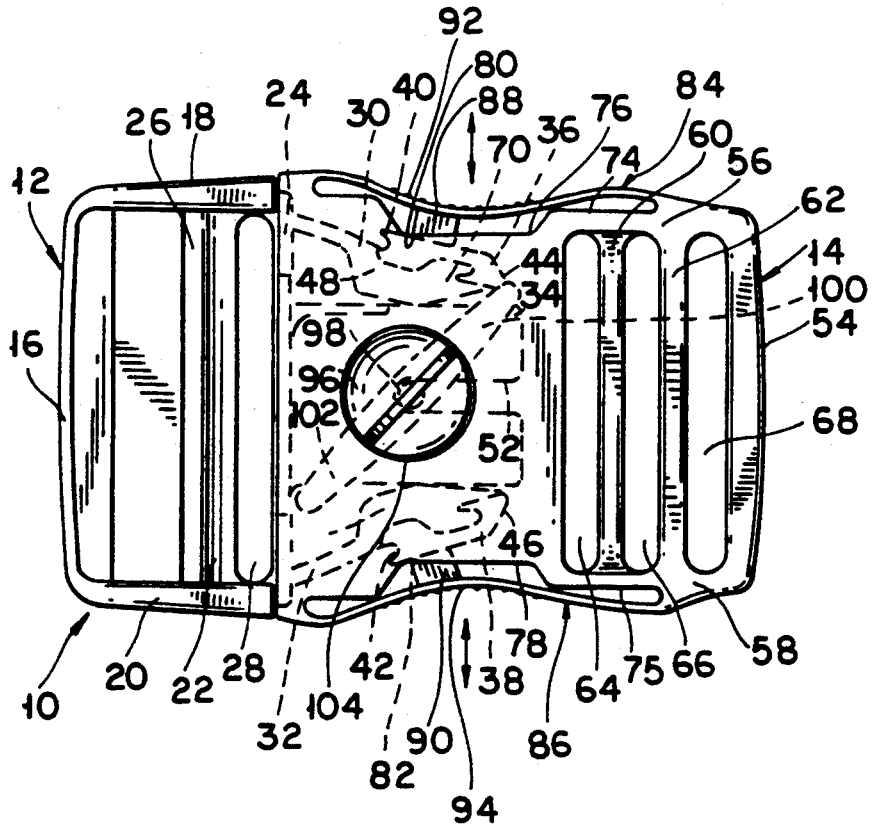
FIG. 4 is a front plan view, partly in phantom, of the engaged male and female portions of the buckle, with the rotatable locking assembly allowing the depression of the spring arms via depression of the lateral release guards.

Female portion 14 includes reverse C-shaped support 24 with horizontal legs 56, 58. Belt supports 60, 62 are formed between legs 56, 58 thereby forming openings 64, 66, 68 through which the belt (not shown) passes. Body 70 of female portion 14 extends from the ends of horizontal legs 56, 58. Body 70 includes passageway 72 facing male portion 12. Passageway 72 receives spring arms 30, 32 and tongue 34. On the lateral walls 74, 75 of body 70 are recesses 76, 78 which include detent apertures 80, 82. Detent apertures 80, 82 are adapted to receive detent protuberances 36, 38 of spring arms 30, 32 thereby latching male portion 12 to female portion 14. As shown in FIGS. 2 and 3, detent protuberances 36, 38 extend through and are exposed through detent apertures 80, 82. However, as detent apertures 80, 82 are within recesses 76, 78, detent protuberances 36, 38 are partially protected from inadvertent depression. Additionally, lateral resilient release guards 84, 86 extend in an arcuate shape above recesses 76, 78 so as to further protect detent protuberances 36, 38 from inadvertent depression. Release guards 84, 86 are comprised of sections 81, 83 and 85, 87, respectively, which meet at an angle to form points of flexure 89, 91, respectively. Release guards 84, 86 include tabs 88, 90 on the inward surfaces thereof which engage detent protuberances 36 when the user depresses release guards 84, 86, as shown in FIG. 4. Additionally, release guards 84, 86 include serrations 92, 94 on the outward surfaces thereof to allow the user a firmer grip thereon.

Centrally located on body 70 is knob 96 which is integral with spindle 98 which is journaled for rotation and passes through the face of body 70. Arms 100, 102 are integral with spindle 98 thereby forming rotatable locking assembly 104. As shown in FIG. 2, when male portion 12 is inserted into female portion 14, slot 52 of tongue 34 engages spindle 98 so that a distal end of tongue 34 passes rotatable locking means 104. Moreover, when internal rotatable locking assembly 104 is rotated from its position shown in FIG. 2 to its position shown in FIG. 3, arms 100, 102 block the depression of spring arms 30, 32 thereby providing an internal locking function.

Figure 5:
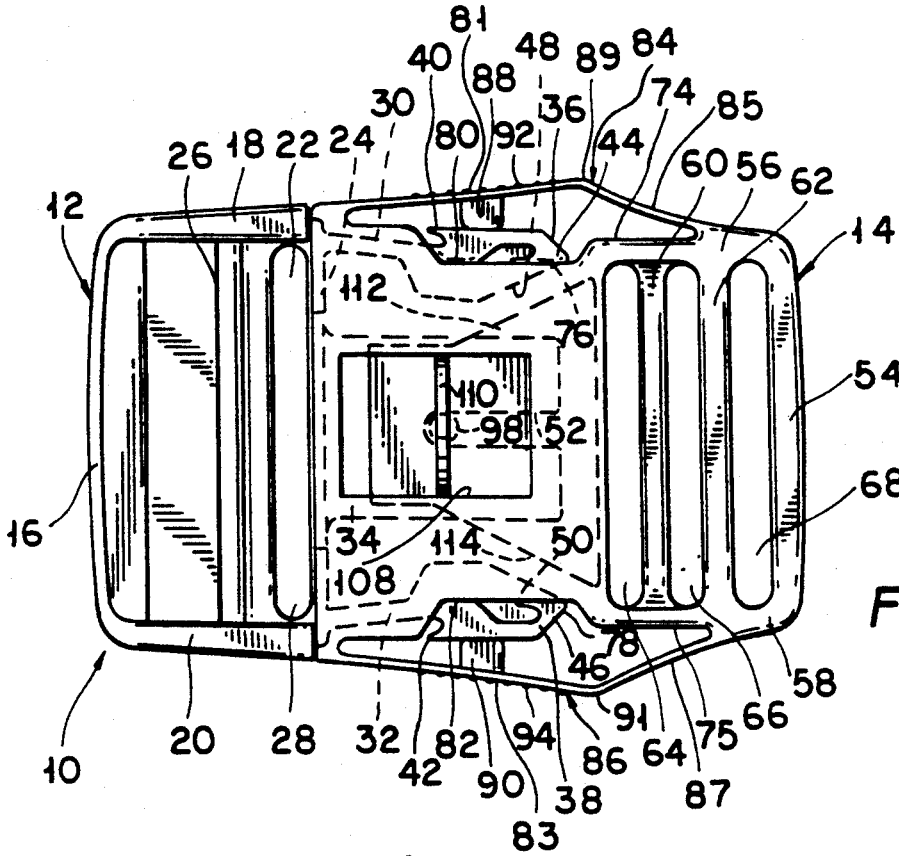
FIG. 5 is a front plan view, partly in phantom, of the engaged male and female portions of the buckle, with the wedge-shaped slidable locking assembly allowing the depression of the spring arms of the lateral release guards.
Figure 6:
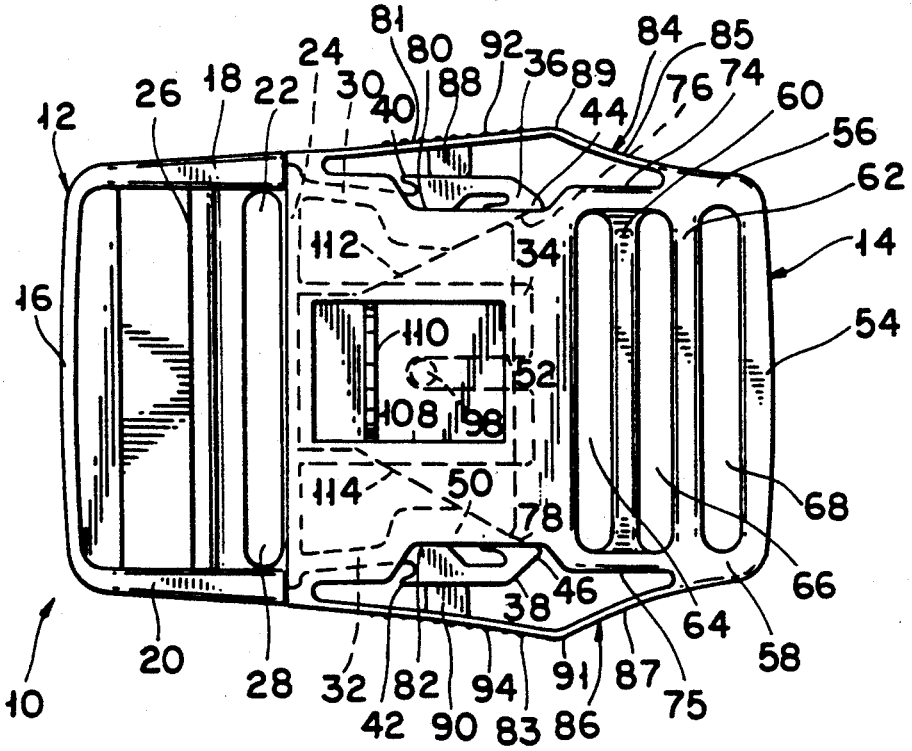
FIG. 6 is a front plan view, partly in phantom, of the engaged male and female portions of the buckle, with the wedge-shaped slidable locking assembly blocking the depression of the spring arms.

Alternately, as shown in FIGS. 5 and 6, knob 96 and arms 100, 102 may be replaced by a wedge 106 slidably engaged in channel 108. Wedge 106 includes outwardly facing thumbpiece 110 and oblique walls 112, 114. Wedge 106 is engaged by guide rails (not shown), or similar means well known to those skilled in the art, in the interior of female portion 14. As shown in FIG. 5, wedge 106 may be positioned toward a distal end of female portion 14 so as to allow spring arms 30, 32 to be depressed thereby allowing the release of male portion 12 from female portion 14. However, as shown in FIG. 6, wedge 106 may be positioned toward a proximal end of female portion 14 so that oblique walls 112, 114 prevent the depression of spring arms 30, 32 thereby locking male portion 12 to female portion 14.

To use this buckle 10, belts (not shown) are attached to the male portion 12 and the female portion 14 via belt supports 22, 60, 62. Knob 96 is rotated so that internal rotatable locking assembly 104 is in a non-obstructing position such as is shown in FIG. 1 or wedge 106 is similarly positioned via thumbpiece 110 as shown in FIG. 5. Spring arms 30, 32 and tongue 34 of male portion 12 are inserted into body 70 of female portion 14. Slot 52 of tongue 34 engages spindle 98. The action of tapered faces 44, 46 of detent protuberances 36, 38 against lateral walls 74, 75 forces spring arms 30, 32 inward until detent protuberances 36, 38 align with detent apertures 80, 82. Spring arms 30, 32 then spring outwardly to secure detent protuberances 36, 38 into detent apertures 80, 82. Concave hook portions 40, 42 further secure detent protuberances 36, 38 to prevent male portion 12 from being pulled from female portion 14. This results in the buckle 10 being in the configuration shown in FIG. 2. The user then rotates knob 96 so as to rotate arms 100, 102 of internal rotatable locking assembly 104 to prevent the depression of spring arms 30, 32 as shown in FIG. 3. Alternately, the user slides wedge 106 in channel 108 via thumbpiece 110 so that oblique walls 112, 114 prevent the depression of spring arms 30, 32 as shown in FIG. 6.

To release buckle 10, the user rotates knob 96 from its position shown in FIG. 3 to its position shown in FIG. 2 or moves wedge 106 from its position shown in FIG. 6 to its position shown in FIG. 5 so that arms 100, 102 on oblique walls 112, 114 are not blocking the depression of spring arms 30, 32. The user pushes serrations 92, 94 of release guards 84, 86 so as to urge tabs 88, 90 against detent protuberances 36, 38 thereby urging spring arms 30, 32 inwardly and releasing detent protuberances 36, 38 from detent apertures 80, 82 thereby allowing male portion 12 to be removed from female portion 14.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A buckle comprising:

a male portion including at least one resilient inwardly deformable spring arm with a detent protuberance at a free end thereof, wherein said male portion includes one of said spring arms at each lateral end thereof and a tongue means proximate between said spring arms;

said tongue means engaging guide means within said female portion;

said guide means including post means comprising a spindle of a rotatable lock means, said spindle being rotatable responsive to a knob on an exterior face of said female portion, said rotatable locking means further comprises arms extending from said spindle which can be rotated from a first position to a second position, wherein said first position allows free flexure of said at least one spring arm and wherein said second position prevents said at least one spring arm from being urged inwardly thereby ensuring that said detent protuberance remains engaged within said at least one detent aperture;

a female portion receptive to said at least one spring arm of said male portion, said female portion including at least one detent aperture formed within corresponding detent recesses on lateral sides of said female portion through which said detent protuberance is exposed when said male portion is engaged within said female portion; and resilient release guard means extending outwardly from said female portion adjacent to said at least one detent aperture so as to shield said detent protuberances from being inadvertently urged inwardly; and wherein said release guard means is urged inwardly by a user so as to engage and urge inwardly said detent protuberance to disengage said male portion from said female portion;

said detent protuberances shaped so as to urge said spring arms inwardly as said male portion is inserted into said female portions, said spring arms flexing outwardly into a detent position when said detent protuberances align with said at least one detent aperture.

2. The buckle of claim 1 wherein said release guard means includes inwardly facing tabs to engage said detent protuberances when said release guard means is depressed.

3. A buckle comprising:

a male portion including at least one resilient inwardly deformable spring arm with a detent protuberance at a free end thereof, wherein said male portion includes one of said spring arms at each lateral end thereof and a tongue means proximate between said spring arms;

said tongue means engaging guide means within said female portion;

said guide means including post means;

a female portion receptive to said at least one spring arm of said male portion, said female portion including at least one detent aperture formed within corresponding detent recesses on lateral sides of said female portion through which said detent protuberance is exposed when said male portion is engaged within said female portion; and resilient release guard means extending outwardly from said female portion adjacent to said at least one detent aperture so as to shield said detent protuberances from being inadvertently urged inwardly; and wherein said release guard means is urged inwardly by a user so as to engage and urge inwardly said detent protuberance to disengage said male portion from said female portion;

said detent protuberances shaped so as to urge said spring arms inwardly as said male portion is inserted into said female portions, said spring arms flexing outwardly into a detent position when said detent protuberances align with said at least one detent aperture; and a slidable locking means in said female portion, wherein said slidable locking means comprises a wedge within said female portion with a handling means slidably engaged and extending outward through a channel in an exterior face of said female portion, said wedge further comprising oblique walls which slide from a first position to a second position, wherein said first position allows free flexure of said at least one spring arm and wherein said second position prevents said at least one spring arm from being urged inwardly thereby ensuring that said detent protuberance remains engaged within said at least one detent aperture.

* * * * *